US006338264B1

(12) United States Patent
Harsch et al.

(10) Patent No.: US 6,338,264 B1
(45) Date of Patent: Jan. 15, 2002

(54) TRANSFER DRIVE FOR A PRESS

(75) Inventors: Erich Harsch, Weingarten; Rainer Reichenbach, Schlier, both of (DE)

(73) Assignee: Mueller Weingarten AG, Weingarten (DE)

( * ) Notice: Subject to any disclaimer, the term of this patent is extended or adjusted under 35 U.S.C. 154(b) by 0 days.

(21) Appl. No.: 09/625,959

(22) Filed: Jul. 26, 2000

(30) Foreign Application Priority Data

Jul. 27, 1999 (DE) ..... 199 34 460
Mar. 11, 2000 (DE) ..... 100 12 022

(51) Int. Cl.[7] ..... B21D 43/05
(52) U.S. Cl. ..... 72/405.16; 72/405.13; 198/621.3
(58) Field of Search ..... 72/405.16, 405.13, 72/405.11, 405.09, 405.01; 198/621.1, 621.3

(56) References Cited

U.S. PATENT DOCUMENTS 3,760,957 A * 9/1973 Berger ..... 72/405
4,133,199 A * 1/1979 Shirao ..... 72/421
4,811,834 A * 3/1989 Asano ..... 198/621.1
4,873,860 A * 10/1989 Werner ..... 72/421
4,966,274 A * 10/1990 Wilolenbrock ..... 198/621.1
5,267,463 A * 12/1993 Doyama ..... 72/405
5,488,852 A * 2/1996 Nishikawa ..... 72/405.13

FOREIGN PATENT DOCUMENTS

| | | | |
|---|---|---|---|
| DE | 0 210 745 A2 | 2/1987 | |
| DE | 38 42 182 C1 | 9/1989 | |
| DE | 39 13 663 A1 | 10/1990 | |
| DE | 401334 A1 | 2/1991 | |
| EP | 0 394 723 A1 | 10/1990 | |
| SU | 1433594 * | 10/1988 | ..... 72/405.09 |

* cited by examiner

*Primary Examiner*—Daniel C. Crane
(74) *Attorney, Agent, or Firm*—Morgan, Lewis & Bockius LLP

(57) ABSTRACT

A transfer drive is proposed for a press and in particular for a forging machine, in which the intention is to dispense with guides which are sensitive to dirt. For this purpose, the gripper rails are suspended on a hinged-rod arrangement with a three-axis guide system.

17 Claims, 10 Drawing Sheets

TRANSFER DRIVE FOR A PRESS

BACKGROUND OF THE INVENTION

1. Field of the Invention

The invention relates to a transfer drive for a press that preferably has a three-axis transport of workpieces through machining stations.

2. Discussion of the Related Art

A conventional transport device for transporting parts in a transfer press comprises two gripper rails which extend in the transport direction of the parts and, in addition to the longitudinal and lifting movements, carry out an additional transverse movement, gripper elements being provided on the gripper rails themselves. In order that the transport elements do not interfere within the tool space during the machining operation of the press, the gripper rails in the three-dimensional transfer system have to be moved laterally out of the tool space again.

DE 38 42 182 C1 has disclosed a gripper-rail drive for transfer presses, in which the gripper rails execute a three-dimensional traveling movement. In particular, in addition to the conventional longitudinal movement and lifting movement of the two gripper rails extending in parallel, provision is made for an additional transverse movement as a clamping or closing movement for gripping or clamping the workpieces. For this purpose, each gripper rail is hinge-mounted via a push rod on a carriage which can be displaced transversely, in order to adapt to the respective workpiece size. The respective closing movement of the gripper rail is then carried out as a lateral pivoting movement on a carriage which is stationary in the transverse direction, by means of appropriate ball joints. In order to carry out the advancing, clamping and lifting movement of the carrying rails, provision is made for conventional cam disks over which cam-follower levers travel, the drive to the gearbox being provided by the press head. A basic illustration of such a drive or a pair of gripper rails is also reproduced in EP 0 210 745 A2 (FIG. 4).

In addition, DE 39 13 663 A1 has disclosed a transposing device for a transfer press, in which the drive for trolleys in the parts transport direction is provided by a cam-follower lever arrangement. The lifting movement of the running rail is provided via the drive of a cam-follower lever, whose movement is transmitted to the running rail via a longitudinal rod and a deflection device.

The drawback with this conventional art is the fact that the three-dimensional movements have to be assisted by guides which are complicated and sensitive to dirt for the individual movement elements, and make complicated protective coverings necessary. In the case of rough operating conditions with a high accumulation of dirt, such as is the case, for example, in forging presses, the guides for the individual movements are very highly stressed, and functional faults are unavoidable as a result, for example, of grooves or the so-called "fretting" of the guide surfaces. It is particularly disadvantageous if the guides are arranged in the area of the transport plane or even underneath the transport plane.

Object and Advantages of the Invention

The claimed invention is based on the object of providing a transfer drive which, to the greatest possible extent, dispenses with guides which are sensitive to dirt for the individual movement elements.

This object is achieved by the features of the claimed invention.

Advantageous and expedient developments of the transfer drive claimed in Patent Claim 1 are specified in the subclaims.

The claimed invention is based on the knowledge that a transfer drive that is used under rough production conditions must manage as far as possible without guides which are sensitive to dirt for the individual movement elements. Using this knowledge, the claimed invention proposes a transfer drive which comprises movable hinged rods in a suspended arrangement, as a result of which a type of "floating mounting" without additional guides is achieved. In particular, as a result of the use of a three-dimensional drive, a type of "multi-point suspension" is provided, which means that the gripper rails are suspended in a defined way on hinges in all three axes of movement, so that it is possible to dispense with conventional guides because of their sensitivity to dirt. At the same time, it is advantageous that all the hinged rods and push rods are arranged above the transport plane of the parts, so that the transport space located underneath can be equipped without any guides which can become dirty for the transfer drive. Accordingly, the transfer drive is equipped with hinged rods or push rods and levers for all movements of the gripper rails in all three directions of movement, since these items of equipment are connected to one another via rotary joints, which can be sealed off much better against dirt than conventional linear guides. In particular for use in a forging company, the arrangement of the transfer above the transport plane is advantageous, that is to say the dirt which accumulates at the bottom cannot hamper the transfer drive.

A further significant advantage of this arrangement consists in the good accessibility of the working space, for example for the spraying system of the mold engraving or in the event of a die change.

Further details and advantages of the claimed invention emerge from the following description of exemplary embodiments in conjunction with the drawings.

BRIEF DESCRIPTION OF THE DRAWINGS

FIG. 1 shows an end view of the forging machine with the transfer drive in the press inlet area, FIG. 2 shows a front view of the transfer drive in the end area of the press, and FIG. 3 shows a side view of the press with a side view of FIGS. 1 and 2, FIGS. 4 to 6 show a second embodiment of a transfer of a forging machine in a variant having a common lever and closing drive, with the same arrangement as specified in relation to FIGS. 1 to 3.

DETAILED DESCRIPTION OF THE PREFERRED EMBODIMENTS

Figure 3:
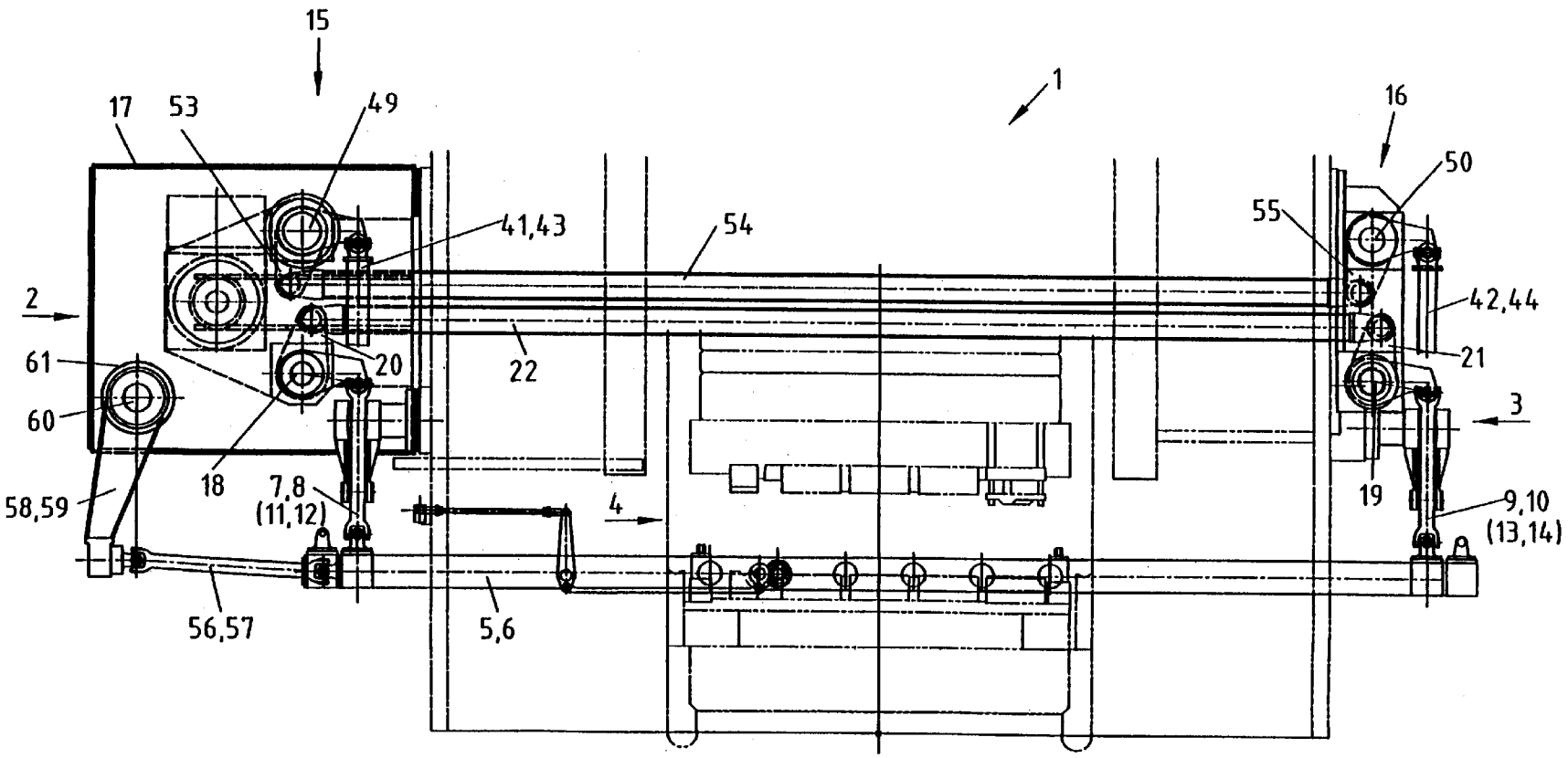

A first gripper as rail 5 and a second gripper rail 6, run in a transport direction 4 through a forging machine or forging press 1, and are suspended cardanically on four hinged rods 7 to 14 each. In this embodiment the gripper rail 5 in a front machine area 15 is carried by the two hinged rods 7, 8, and in a rear machine area 16 by the hinged rods 9, 10. This can be seen in the side view of FIG. 3. The further gripper rail 6, located outside the plane of the drawing in FIG. 3, is carried in the front area 15 by the hinged rods 11, 12 and in the rear area 16 by the hinged rods 13, 14.

Located in a cam box 17 in the front machine area 15 is a lever shaft 18, and in the rear machine area 16 is a lever shaft 19, which are operatively connected to each other via levers 20, 21 and a push rod 22 in each case.

Fixed to the lever shafts 18, 19 are levers 23 to 26, on which the individual hinged rods 7 to 14 are suspended cardanically.

The lever shaft 18 is rotatably mounted in the cam box 17 and is driven by a pair of cams 27 via a roller lever 28 (cam-follower lever) . The lever shaft 19 arranged in the rear machine area 16 is rotatably mounted in bearing blocks 29, 30. Drive to the lever shaft 19 is provided by the lever shaft 18 via the lever arrangement 20, 21 with push rod 22. The lifting movement of the gripper rails 5, 6 is carried out by means of this kinematic system.

Figure 1:
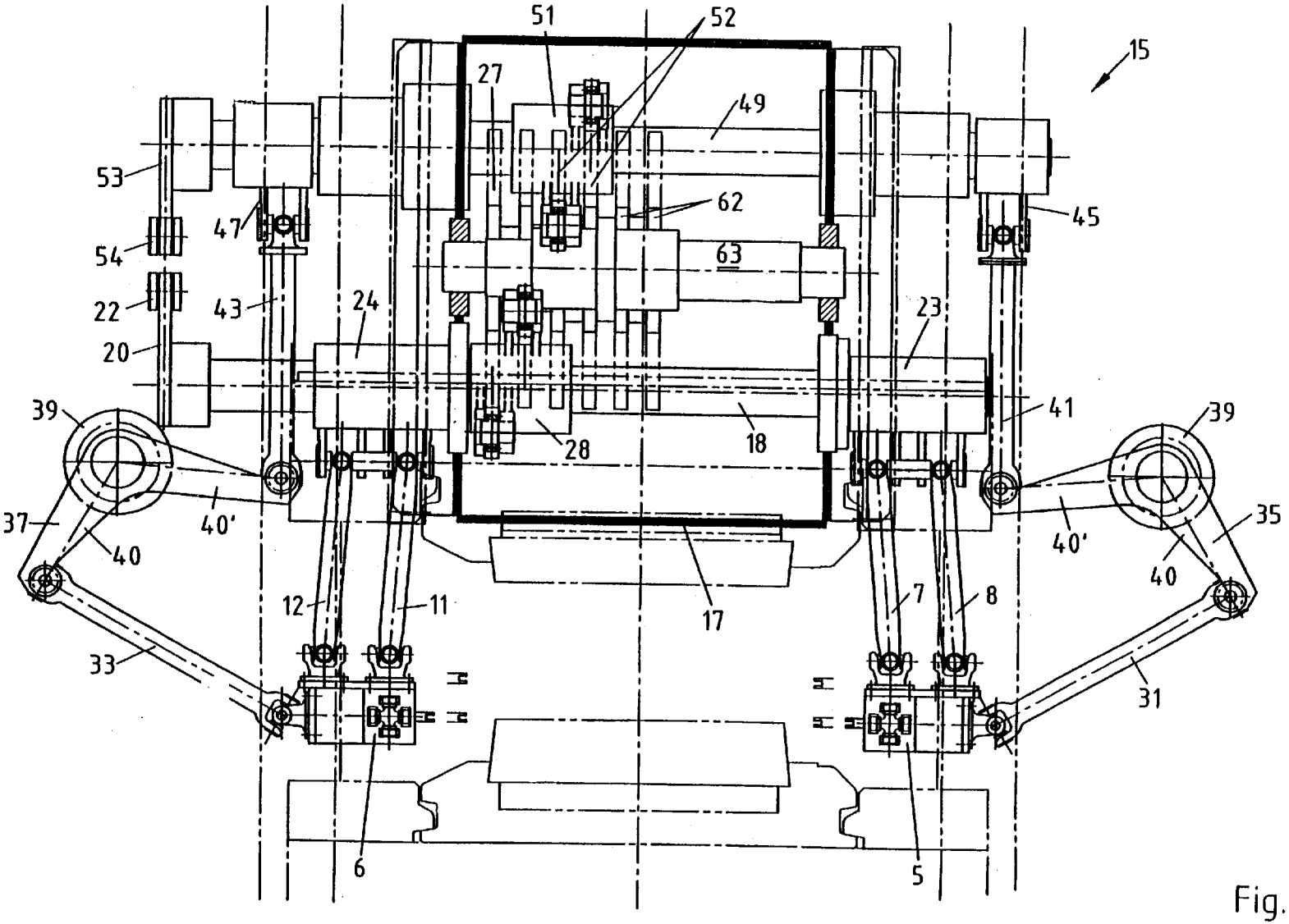
FIGS. 1 to 3 show a first embodiment of a transfer for a forging machine with a transfer drive for a gripper-rail arrangement.
Figure 2:
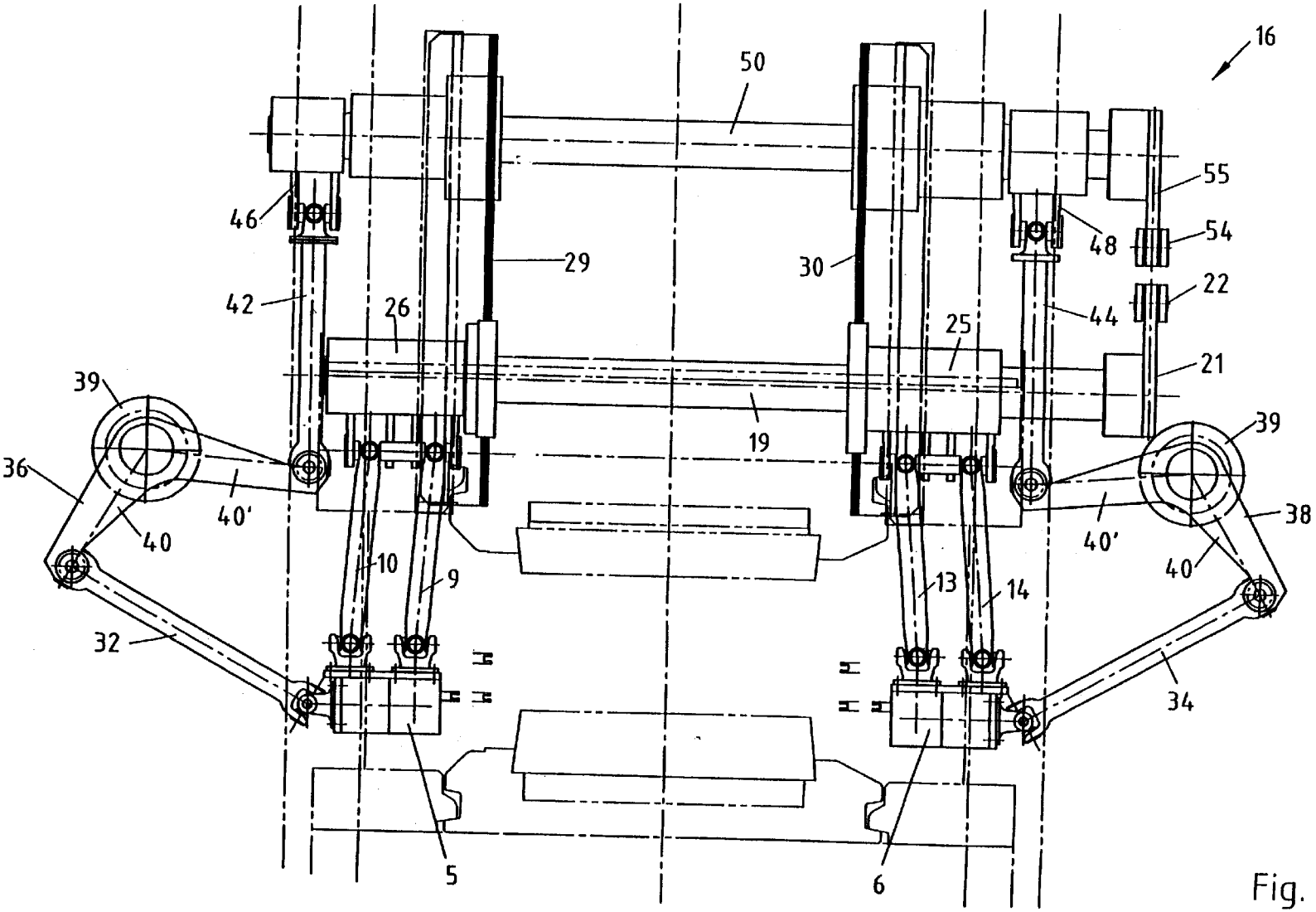

Closing movement of the gripper rails 5, 6 is carried out via additional hinged rods 31 to 34, the hinged rods 31, 32 being articulated cardanically at a side of the gripper rail 5 in the front machine area 15 and rear machine area 16. Equally, the hinged rods 33, 34 are articulated cardanically at the side to the gripper rail 6 in the front and rear machine areas 15, 16. In this regard, reference is made to FIGS. 1, 2.

The hinged rods 31 to 34 are each articulated to a first leg 40 of an angled lever 35 to 38, which is in each case held in a bearing 39. A respective further leg 40' of the respective angled lever 35 to 38 is in each case connected to a hinged rod 41 to 44 which for their part are connected via levers 45 to 48 to a lever shaft 49, 50 in each case. The drive to the lever shaft 49 in the front machine area 15 is in turn provided via a roller lever 51 by means of a pair of cams 52 in the cam box 17 in the front machine area 15. This rotary movement of the lever shaft 49 in the front machine area 15 is in turn transmitted, via a lever 53, a push rod 54 and via a lever 55 to the lever shaft 50 in the rear machine area 16.

Advancing movement for the gripper rails 5, 6 is provided by hinged rods 56, 57, which are in each case connected cardanically to the gripper rails 5, 6. Via a cardanic connection to a lever 58, 59 in each case, a common lever shaft 60 is reached, which is driven via a roller lever 61 by a pair of cams 62.

A camshaft 63 is driven by the press drive itself and serves to drive the advancing mechanism, the clamping and closing mechanism and the lifting/lowering mechanism.

The possible distortions which arise as a result of the lever and push-rod mechanisms are taken into account when calculating the cam paths, so that the movements of the gripper rails take place precisely with the appropriate intercepting movement curves.

Second Embodiment

Figure 4:
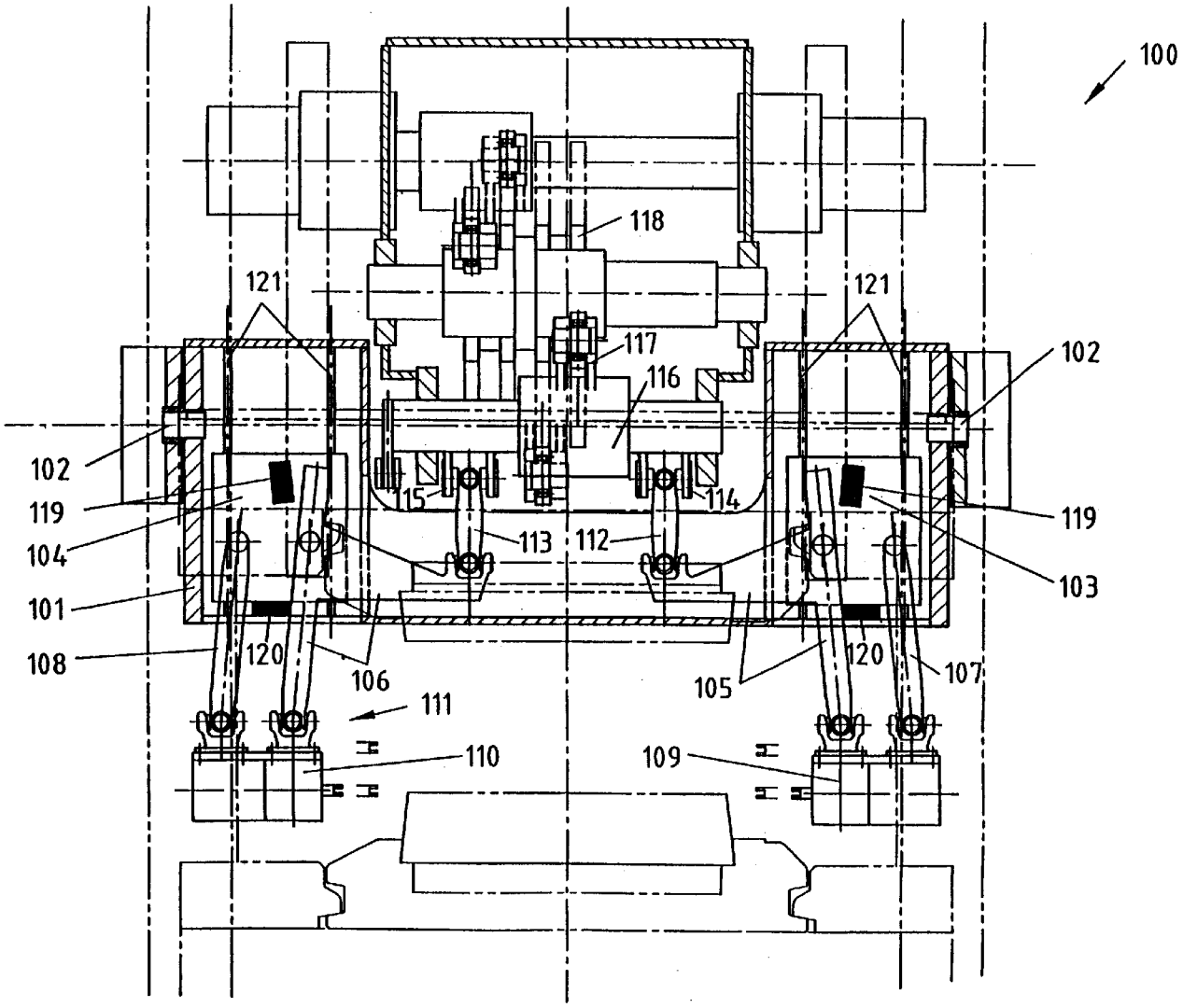
Figure 5:
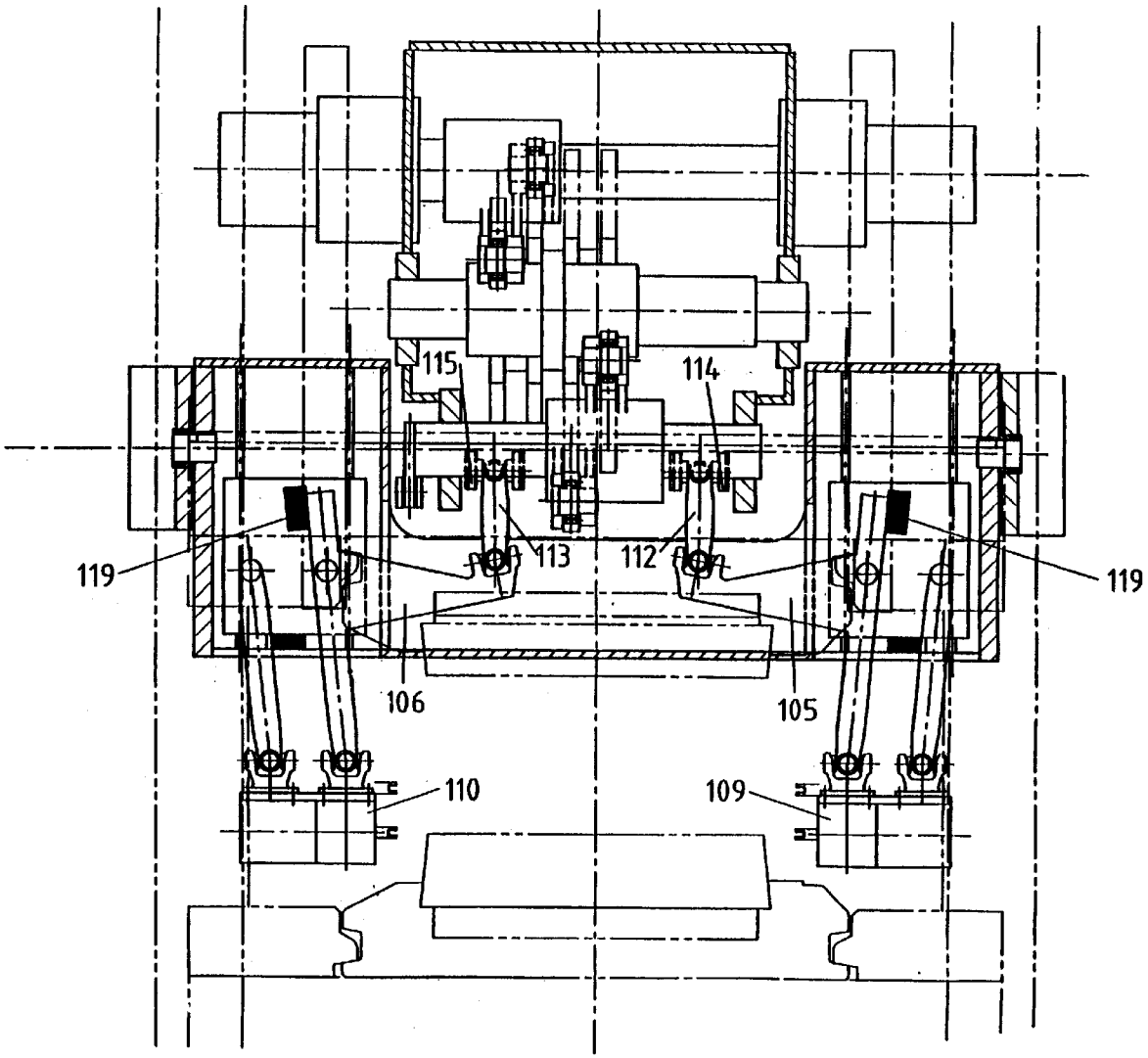
Figure 6:
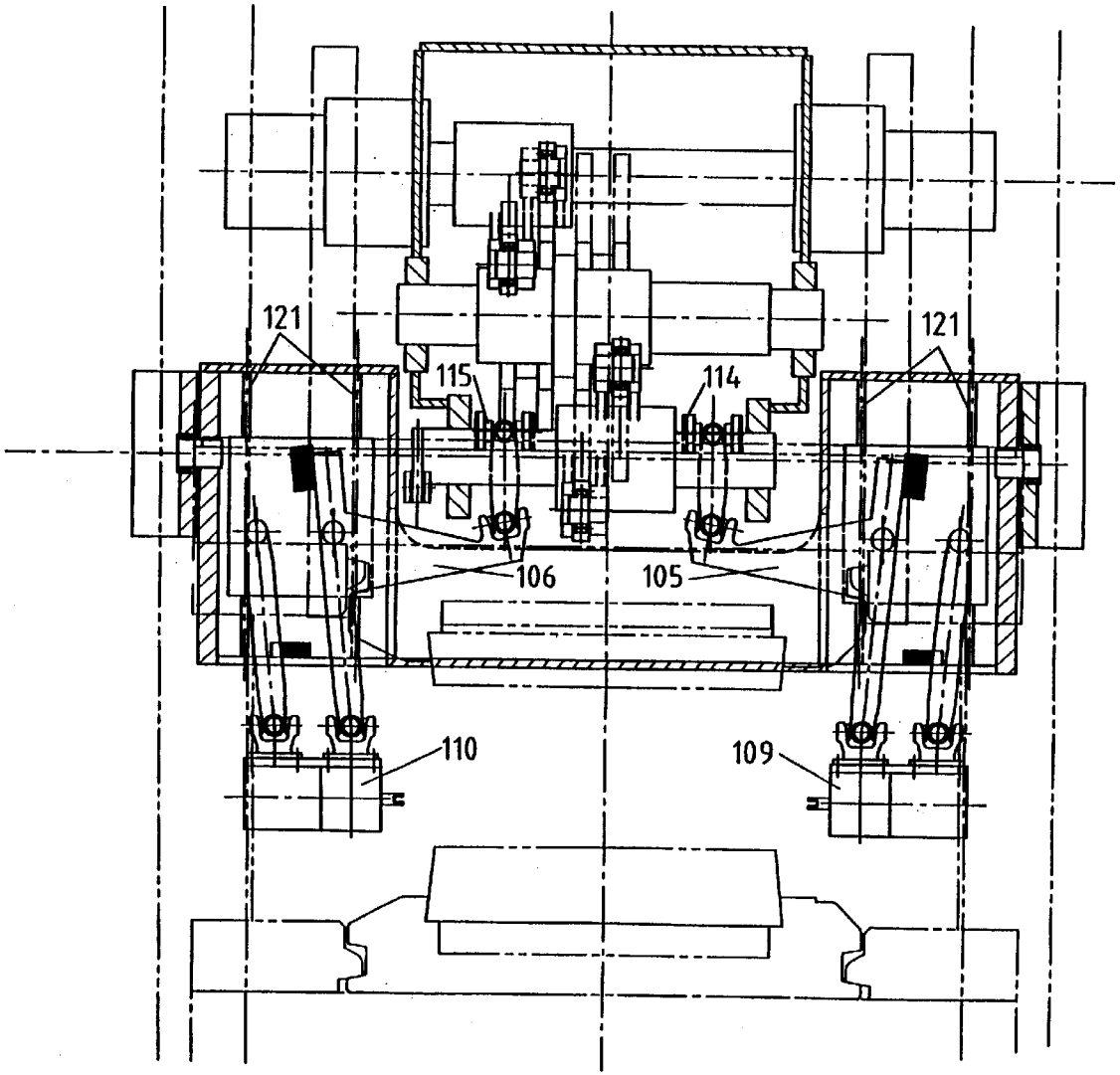

A second embodiment of the claimed invention according to FIGS. 4 to 6 shows a transfer having a common lifting and closing drive. In this embodiment, FIG. 4 shows a basic position with a lowered transfer in an opened clamping and closing device. FIG. 5 shows the position for parts removal, with the transfer lowered in a closed position. Finally, FIG. 6 shows a transfer in the lifted transport position with a closed closing and clamping mechanism.

In a three-axle transfer, it is usual for three movements, namely advancing, lifting and closing, each to be produced by a cam mechanism. This is also indicated in the first embodiment, previously described.

A saving in costs can be achieved by the lifting and closing movements being carried out by a common cam mechanism, that is to say a vertical and a transverse movement are produced from one movement. According to the illustration in FIGS. 4 to 6, this is achieved by means of the following measures in the transfer drive 100 illustrated there.

In a rocker 101, which is mounted such that it can be pivoted about a pivot 102, two angled levers 105, 106 and one articulated lever 107, 108 in each case are rotatably mounted in two vertically displaceable carriages 103, 104. Gripper rails 109, 110 are suspended cardanically on the angled and articulation levers 105 to 108 by means of cardan joints 111.

The angled levers 105, 106 are suspended via a cardanically mounted push rod 112, 113 each in a lever 114, 115 each, the latter being driven by the cam mechanism 118 via a lever shaft 116 and roller lever 117.

Closing movement for the gripper rails 109, 110 is limited at the bottom by a stop 119, and the lifting movement is limited at the bottom by a stop 120.

As a result of the levers 114, 115 being lifted, the gripper rails 109, 110 carry out a closing movement as far as the stop 119. As a result of further lifting of the levers 114, 115, a lifting movement is carried out, the carriage 103, 104, which is mounted in the guides 121, being lifted.

As a result of the levers 114, 115 being lowered, the carriage 103, 104 carries out a lowering movement down to the stop 120. During the further lowering of the levers 114, 115, the gripper rail 109, 110 carries out an opening movement, brought about by the angled levers 105, 106 being pivoted.

Between lifting and closing, the cam mechanism assumes a latching position, in order to avoid the stops being struck hard. The rest of the drive mechanism is carried out in a manner similar to the embodiment according to FIGS. 1–3.

Figure 7:
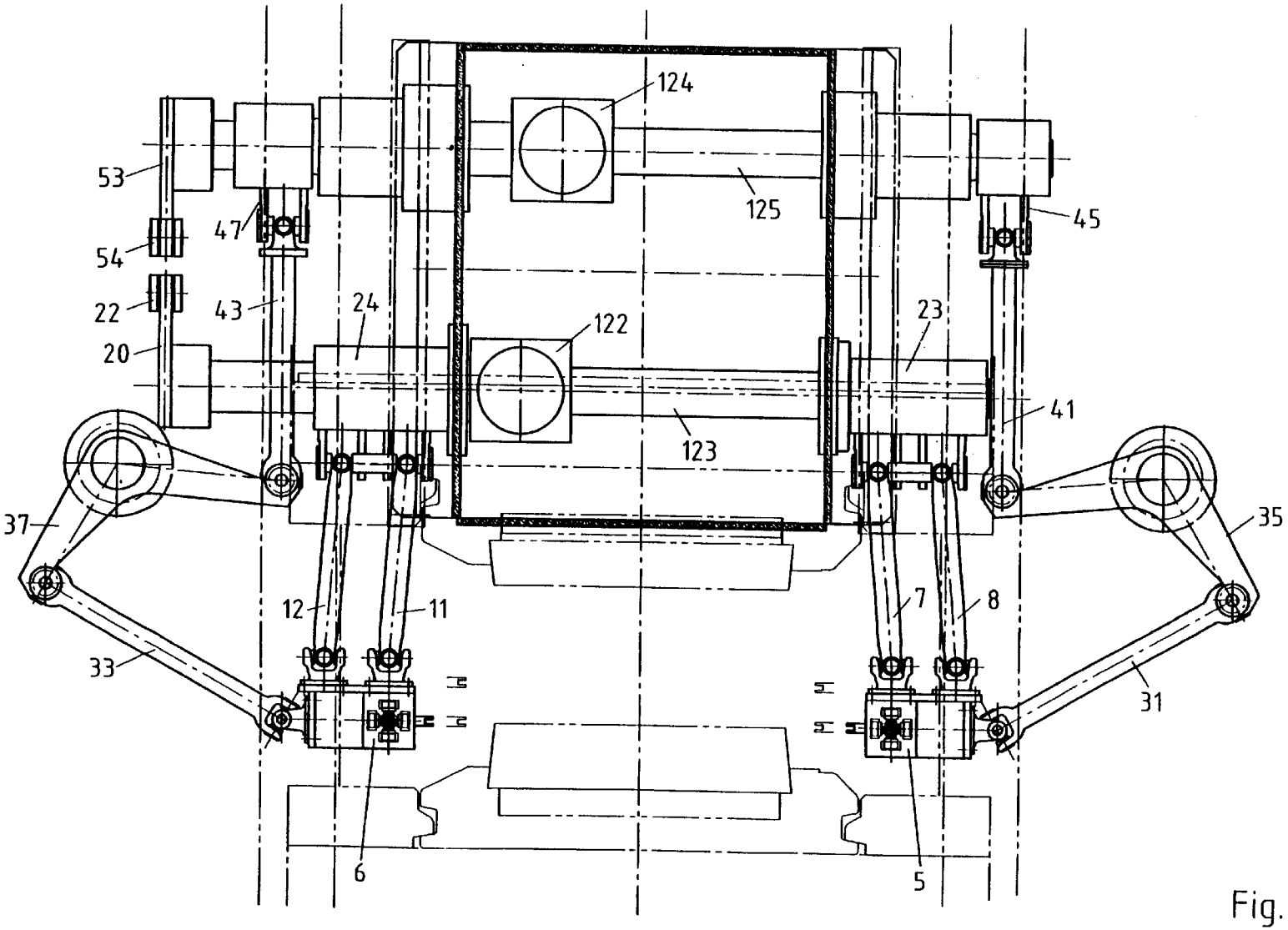
FIGS. 7 to 8 show a third embodiment of a transfer with separate drives for the movement axes, so-called electronic transfer.
Figure 8:
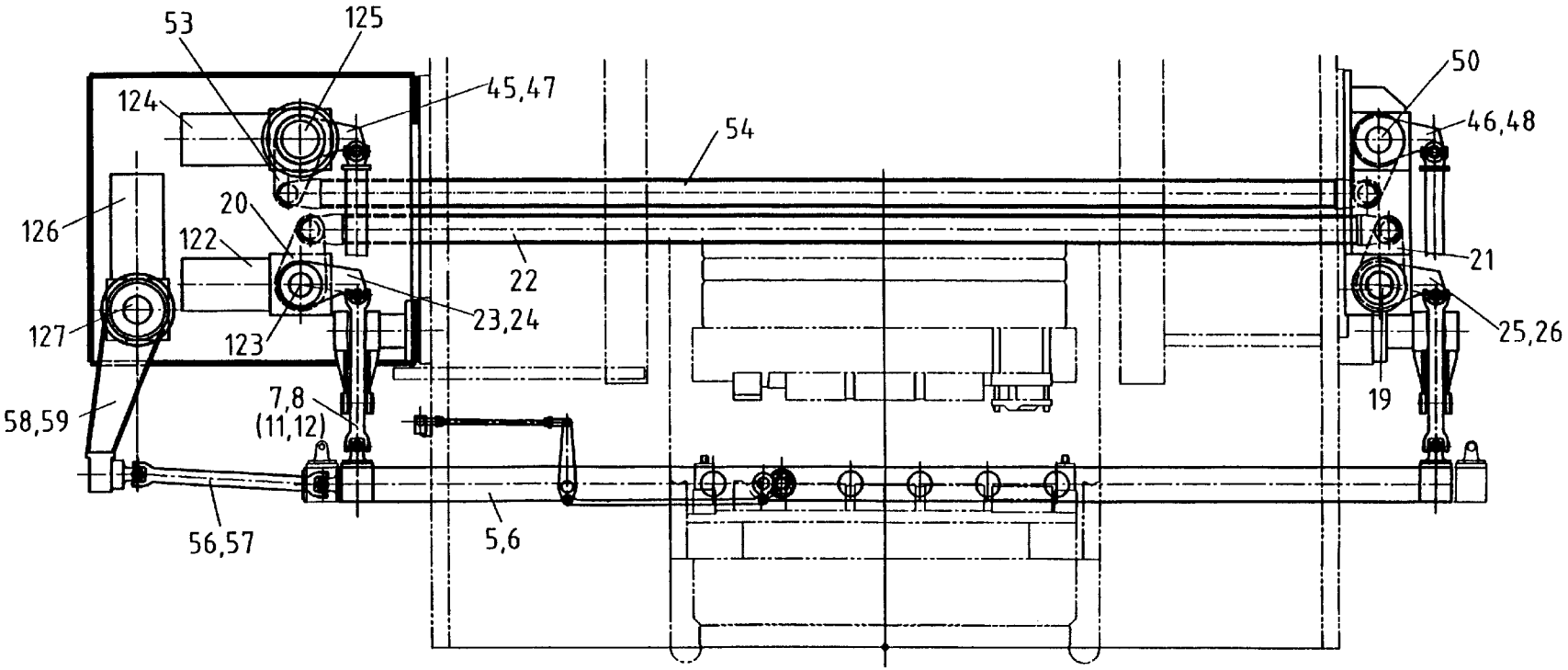

From the illustration in FIGS. 7 and 8, the suspension, mounting and guidance of the gripper rails 5, 6 is virtually identical to the embodiments already described. For the purpose of better understanding, the same reference numbers have been used.

The new feature is that the movements are no longer carried out via the central press drive, but separate, controllable drives are used. As a result of forcible synchronization with the press movements the movement sequences described in FIGS. 1 through 6 are broken up in favor of a flexible transfer system which can be adjusted optimally to the respective reforming process. Synchronization is carried out in the form of the known electronic shaft. The drive motors (not shown) used are preferably controlled-speed, electrically or hydraulically driven motors. Control can be carried out as a closed control loop. Magnitude of the respective movement is no longer predefined by a cam but can be carried out individually by controlling the drives.

A lifting drive 122 moves a lifting shaft 123, on which levers 23, 24 are fixed. Execution of the lifting movement corresponds to the sequence already described, but time, magnitude of lift and lifting speed can be selected freely by controlling the lifting drive 122.

Closing movement is initiated by closing drive 124, via closing shaft 125. Closing shaft 125 drives, via levers 45, 47, a kinematic chain for the closing stroke of the gripper rails 5, 6 in the form already described.

In order to transmit lifting and closing movement or pivoting movement of the shafts 123, 125 from the start of the transfer to the end of the transfer, use is again made of push rods 22, 54.

An advance drive 126 produces a horizontal part of a transport step of the gripper rails 5, 6 via advance shaft 127, levers 58, 59 and hinged rods 56, 57.

Figure 9:
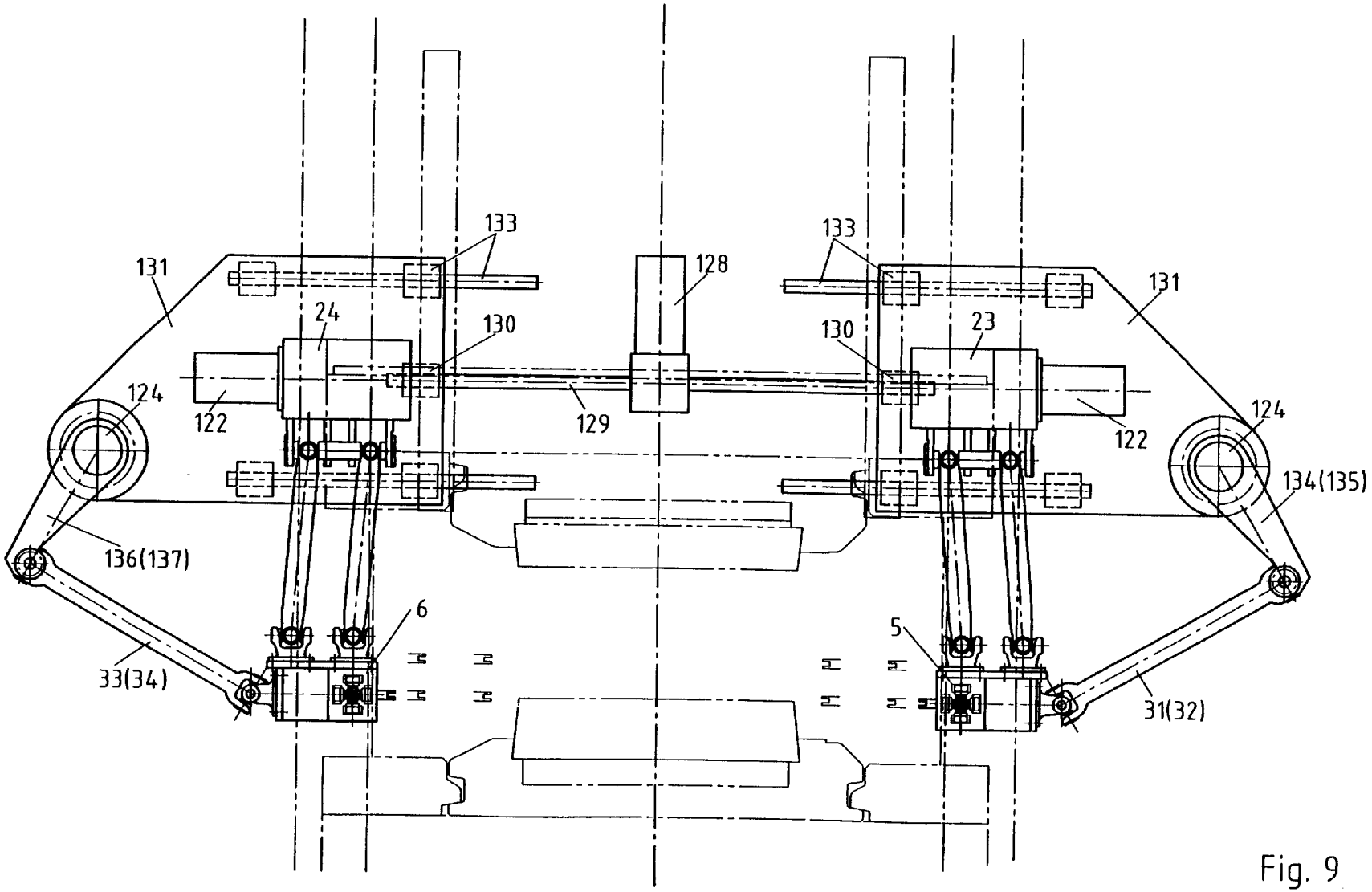
FIGS. 9 and 10 show a fourth embodiment of a transfer with separate drives with the additional function "width adjustment".
Figure 10:
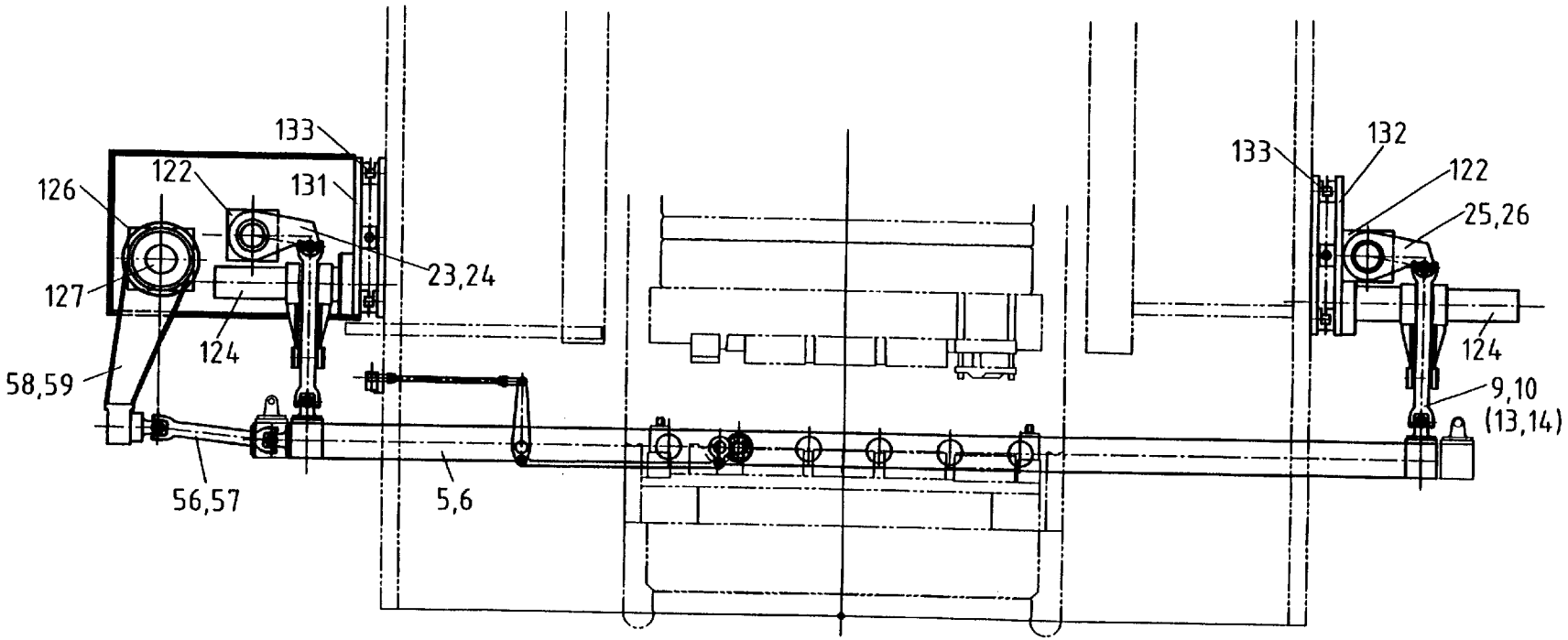

If adaptation to different width dimensions of workpieces is also required in a transfer system, such as is the rule in an automatic stamping machine, for example, a design according to FIGS. 9 and 10 is proposed.

Drive 128 drives the spindle 129, which is connected to nuts 130 fixed to fitting plates 131, 132. The fitting plates 131, 132 are mounted in guides 133 such that they can be displaced horizontally. Since the drive and guide elements of the lifting and closing movement of the gripper rails 5, 6 are located on the fitting plates 131, 132, a width adjustment can be carried out in a simple way by means of a horizontal movement.

In another embodiment, the lifting and closing shafts 123, 125 are omitted, and for each gripper rail 5, 6 a separate lifting drive 122 and closing drive 124 are proposed. By this means, flexibility of the transfer system is further increased and permits, for example, transversely with respect to the transport direction, oblique positioning of the gripper rails 5, 6 in relation to each other or an asymmetrical closing movement referred to the closing drive. If push rods 22, 54 are also omitted, and if dedicated lifting drives 122 and closing drives 124 are likewise provided at the transfer end, then oblique positioning of the gripper rails in the transport direction is also possible. In a simple constructional design, the closing movement is carried out by levers 134 to 137 being fixed to the respective closing drive 124 and initiating the closing movement of the gripper rails 5, 6 via hinged rods 31 to 34. In the function described in FIGS. 7, 8, the advance drive 126 is common.

If width adjustment is not required, this device illustrated in FIGS. 9 and 10 can be omitted. The embodiment then comprises an arrangement of the drives for closing, lifting and advancing, according to the illustration and description of FIGS. 9 and 10.

While the claimed invention has been disclosed with reference to certain preferred embodiments, numerous modifications, alterations, and changes to the described embodiments are possible without departing from the sphere and scope of the claimed invention, as defined in the appended claims. Accordingly, it is intended that the claimed invention not be limited to the described embodiments, but that it have the full scope defined by the language of the following claims, and equivalents thereof.

What is claimed is:

1. A transfer drive for a press comprising,:

a three-axis transport of workpieces through machining stations, having two gripper rails arranged parallel to each other;

a horizontal longitudinal movement performed by an advance mechanism;

lifting and lowering movements performed by a lifting mechanism; and a transverse movement performed by a closing mechanism, wherein the gripper rails are suspended and guided by a hinged rod arrangement of first, second, and third sets of hinged rods and hinged drive rods, a respective set for moving the gripper rails in a horizontal longitudinal movement, lifting and lowering movements and transverse movement;

such that the transverse movement is solely guided by a respective set of hinged rods and hinged drive rods.

2. The transfer drive according to claim 1, wherein the gripper rails are suspended cardanically, without additional guides, in three axes of movement in a multi-point suspension on at least four hinged rods from a first and a second set of hinged rods whereby the hinged rods are raised and lowered by first and second lever shafts with a first set and a second set of levers.

3. The transfer drive according to claim 2, wherein performing the lifting and lowering movement, the hinged rods from the first and second sets of hinged rods are suspended at upper ends in the first and second sets of levers which are driven by cam control via the first and second lever shafts and roller levers.

4. The transfer drive according to claim 1, wherein to perform the closing movement of the gripper rails, a third set of hinged rods are operated via a first set of angled levers, the first set of angled levers being driven by third and fourth lever shafts with individual levers and associated hinged rods.

5. The transfer drive according to, claim 1, wherein to perform an advancing movement of the gripper rails, a cam-disk drive acts on a lever shaft via a roller lever, whereby the lever shaft drives drive levers, and the drive levers drive hinged drive rods connected to the gripper rails.

6. The transfer drive according to claim 1, wherein the gripper rails are each assigned two front hinged-rod arrangements and are each assigned two rear hinged-rod arrangements for the lifting and lowering movements, and are each assigned a front and a rear hinged rod for the closing movement, the front and rear hinged-rod arrangements being operatively connected to one another via push rods.

7. The transfer drive according to claim 2, wherein the first and second set of hinged rods for the lifting and lowering movements and the third set of hinged rods for the closing movement are driven by a cam-controlled lever shaft.

8. The transfer drive according to claim 1, wherein to perform both the lifting and closing movements a fourth set of hinged rods connected to the gripper rails is formed as an angled lever, mounted in a carriage that can be displaced vertically, and a third and fourth set of levers mounted on a lever shaft performs a pivoting and lifting movement of the angled levers respectively suspended cardanically thereon.

9. The transfer drive according to claim 7, wherein the closing movement and the lifting movement are limited by first and second stops for the angled levers.

10. The transfer drive according to claim 2, wherein the gripper rails are suspended cardanically, without additional guides, in three axes of movement in a multi-point suspension on at least four of the first and second set of hinged rods whereby the hinged rods are raised and lowered by a lifting drive and lifting shaft with the first and second set of levers performing the lifting and lowering movements.

11. The transfer drive according to claim 4, wherein to perform the closing movement of the gripper rails hinged rods are operated via the first set of angled levers, the angled levers driven by a closing drive and a closing shaft with the individual levers and the associated hinged rods.

12. The transfer drive according to claim 5, wherein to perform the advancing movement of the gripper rails an advance drive drives the drive levers via an advance shaft, and said levers drive the hinged drive rods connected to the respective gripper rail.

13. The transfer drive according to claim 1, wherein the lifting and closing mechanisms are mounted on fitting plates, and the fitting plates are guided and mounted in horizontal guides.

14. The transfer drive according to claim 13, wherein first and second nuts are fixed to the fitting plates and are operatively connected to a drive via a spindle.

15. The transfer drive according to claim 1, wherein the gripper rails are suspended cardanically, without additional guides, in three axes of movement in a multi-point suspension on at least four hinged rods whereby the hinged rods are raised and lowered by the lifting drive with first and second sets of levers performing the lifting and lowering movements.

16. The transfer drive according to claim 1, wherein to perform the closing movement of the gripper rails, the third set of hinged rods are operated via closing levers and the closing levers are driven by the closing drive.

17. The transfer drive according to claim 1, wherein the hinged rod arrangement comprises a cardanic suspension for the gripper rails.

* * * * *